US005197149A

United States Patent [19]

Overton

[11] Patent Number: 5,197,149

[45] Date of Patent: Mar. 30, 1993

[54] ATHLETIC GLOVE WITH BACKHAND SUPPORT

[76] Inventor: V. Parker Overton, P.O. Box 8228, Greenville, N.C. 27834

[21] Appl. No.: 832,450

[22] Filed: Feb. 7, 1992

[51] Int. Cl.[5] ..... A41D 19/00

[52] U.S. Cl. ..... 2/161 A; 2/162

[58] Field of Search ..... 2/159, 158, 161 A, 161 R, 2/160, 163, 169, 16, 20; 602/21, 61, 62

[56] References Cited

U.S. PATENT DOCUMENTS

| | | | |
|---|---|---|---|
| 3,372,401 | 3/1968 | Woodward | 2/159 |
| 4,701,963 | 10/1987 | Overton | 2/161 A |
| 4,730,354 | 3/1988 | Saito | 2/161 A |
| 4,843,651 | 7/1989 | Gramza et al. | 2/163 X |
| 5,004,227 | 4/1991 | Hoffman | 2/161 A X |
| 5,088,122 | 2/1992 | O'Toole | 2/161 A |

*Primary Examiner*—Clifford D. Crowder
*Assistant Examiner*—Sara M. Current

[57] ABSTRACT

An athletic glove includes a back strap to compress and support the wrist and hand of the user. The glove comprises a central portion including a back side and a palm side which define a hand receiving pocket therebetween. A hand opening is formed in the central portion for inserting the user's hand into the pocket. A wrist cuff area encircles the user's wrist and borders the hand opening. A backhand support wraps around the user's hand to provide support for the backhand muscles. The backhand support includes a backhand strap having an intermediate portion and a free end portion. The backhand strap is secured to the central portion of the glove adjacent the finger stall for the user's index finger and extends diagonally backward across the back side of the glove towards the user's wrist. The strap encircles the underside of the user's wrist and then extends diagonally forward across the back side of the glove from the base of the finger stall for the user's thumb towards the finger stall for the user's little finger. The free end portion of the backhand strap intersects an intermediate portion of the backhand strap to which it is secured. A hold-down strap attached to the central portion of the glove adjacent the finger stall for the little finger secures the free end portion of the backhand strap. The glove may also include a wrist strap for encircling the user's wrist to provide support therefor and to secure the glove on the user's wrist.

21 Claims, 2 Drawing Sheets

ATHLETIC GLOVE WITH BACKHAND SUPPORT

FIELD OF THE INVENTION

The present invention relates to gloves, and, more particularly, to an athletic glove having means to compress and support the wrist and hand of the user.

BACKGROUND OF THE INVENTION

Athletic gloves have been developed for a wide variety of sports. Some gloves are particularly designed to improve a person's grip on a ski rope handle, club, bat, exercise bar, or similar device. Examples of such grip improving gloves are shown in U.S. Pat. Nos. 3,274,616 to Russo; 2,852,779 to Roessler; 3,918,097 to Mlodoch and 5,004,231 to Alread. Other gloves are designed to provide wrist support to prevent excessive flexure of the wrist. One such glove is shown in the patent to Wiggins, U.S. Pat. No. 5,033,119. This patent discloses a glove having two elongated, elastic flaps which wrap around the wrist in opposite directions to provide compression and stabilization of the wrist and hand.

Despite the improvement in athletic gloves in recent years, there continues to be a need for an athletic glove designed particularly for water skiers. One problem in particular that has not been addressed in prior art glove designs is the need to provide compression and support for the muscles in the back of the hand. Because skiers are required to maintain a tight grip on the ski rope handle over extended periods of time, the muscles in the back of the hand tend to tire. Accordingly, support is needed for these muscles to prevent tiring. U.S. Pat. No. 4,701,963 to Overton discloses a glove including a back strap. The function of the back strap is to securely fasten the glove to the user's hand, but does not provide compression and enhanced support for the backhand muscles and wrist.

SUMMARY AND OBJECTS OF THE INVENTION

The present invention is an athletic glove which is particularly designed to provide support for the wrist and backhand muscles. The glove of the present invention includes a conventional glove structure which is provided with backhand support means and wrist support means. The backhand support means comprises an elastic backhand strap which is adapted to be stretched and wrapped around the user's hand. The backhand strap is attached to the central portion of the glove structure adjacent the base of the user's index finger. The strap extends diagonally across the back side of the glove towards the user's outer wrist area. The backhand strap then encircles the underside of the user's wrist and extends forwardly across the back side of the glove from the base of the thumb stall towards the base of the little finger stall. The free end portion of the backhand strap intersects with the intermediate portion of the backhand strap. Fastening means are provided for securing the free end portion of the backhand strap to the intermediate portion. Further, a hold-down strap is provided which extends from the base of the little finger stall towards the inner wrist area to meet and engage with the free end portion of the backhand strap. The wrist support means includes a wrist strap which is attached to the wrist cuff area of the glove and encircles the user's wrist. The wrist strap may be tightened as needed by the user to provide varying degrees of support for the user's wrist.

Based on the foregoing, it is an object of the present invention to provide an athletic glove which provides support for the backhand muscles of the user's hand.

Another object of the present invention is to provide an athletic glove which gives support to the user's wrist.

Another object of the present invention is to provide an athletic glove which gives both backhand and wrist support wherein the degree of support can be adjusted by the user.

Another object of the present invention is to provide an athletic glove which will improve the user's grip on athletic equipment, exercise bars, ski rope handles or similar devices.

Another object of the present invention is to provide an athletic glove which is of a durable and reliable construction.

Another object of the present invention is to provide an athletic glove which is suitable for use by water skiers.

Other objects and advantages of the present invention will become apparent and obvious from a study of the following description and the accompanying drawings which are merely illustrative of such invention.

DETAILED DESCRIPTION OF THE INVENTION

Figure 1:
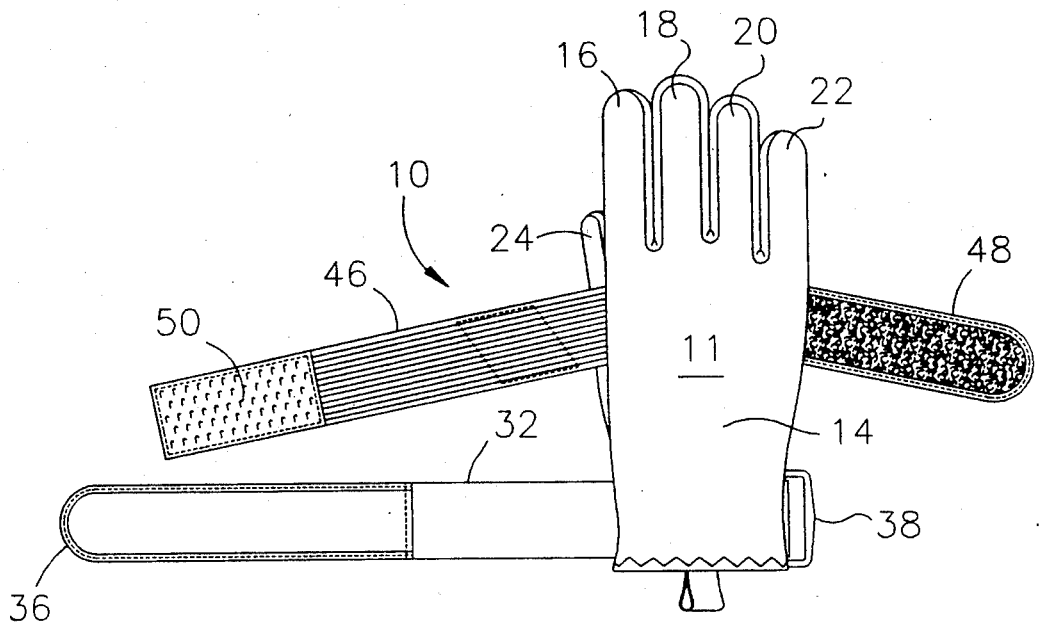
FIG. 1 is a top plan view of the back side of the athletic glove of the present invention.
Figure 2:
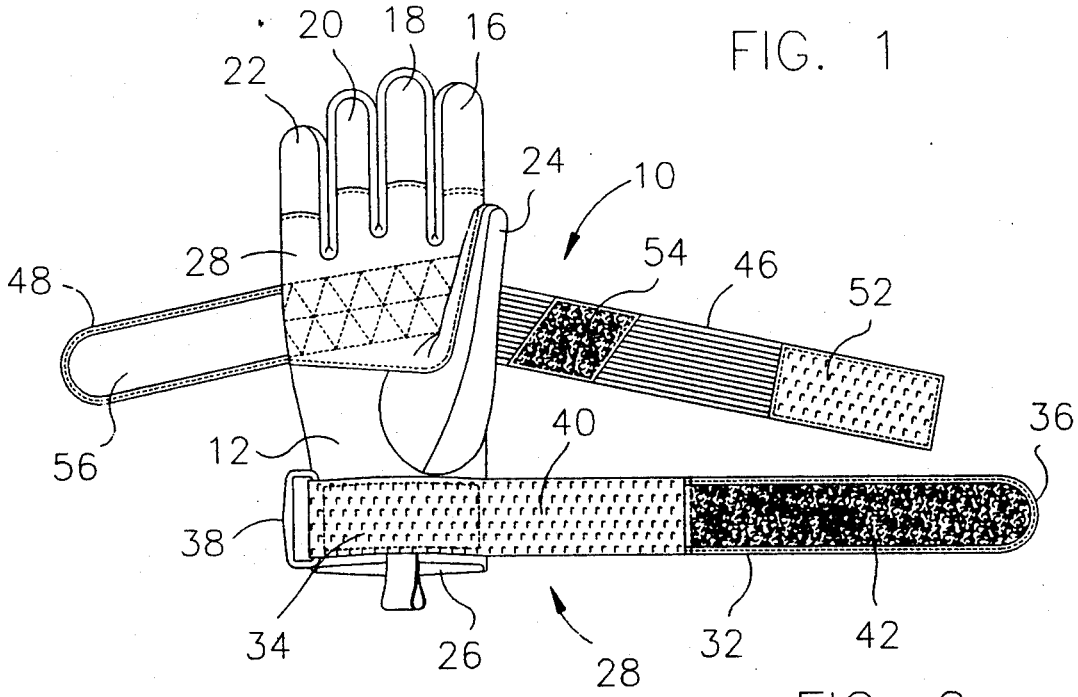
FIG. 2 is a plan view of the palm side of the glove.

With further reference to the drawings, the glove of the present invention is shown therein and indicated generally by the numeral 10. The athletic glove 10 includes a conventional glove structure comprising a central portion 11, four finger stalls 16, 18, 20 and 22, and a thumb stall 24. The central portion 11 includes a palm panel 12 made of neoprene or other stretchable material and a back panel 14 made of suede or other nonstretchable material. The palm panel 12 and back panel 14 are secured together along their outer peripheries by stitching so as to define a hand receiving pocket 16 between the palm and back panels 14 and 16. The palm panel 12 and back panel 14 include finger extensions which define the individual finger stalls 16, 18, 20 and 22 for the index finger, middle finger, ring finger and little finger, respectively. The thumb stall 24 is constructed as a separate component and attached by stitching to the central portion 11 on the palm side. A hand receiving opening 26 is formed adjacent the thumb stall 24 for insertion of the user's hand into the hand receiving pocket 16.

In a preferred embodiment of the invention, a padded reinforcing panel 28 is secured to the palm panel 12. The reinforcing panel 28 covers the finger base region of the palm, the inside of the thumb, and extends up to the intermediate knuckle of the fingers. That is, the portions of the palm panel 12 are covered by the reinforcing panel 28 are those portions that are in contact with the ski rope handle, exercise bar, or similar device.

Thus, the patented reinforcing panel 28 helps the user maintain a firm grip on the athletic equipment.

For securing the glove 10 to the user's hand and providing a measure of wrist support, the glove 10 includes a wrist support means indicated generally at 30. The wrist support means 30 includes a wrist strap 32 attached to the wrist cuff area of the glove. For purposes of this application, the wrist cuff area of the glove 10 is defined as the area of the glove adjacent to the hand opening which surrounds the user's wrist. The wrist cuff area includes portions of both the palm panel 12 and back panel 14.

Referring back now to the wrist strap 32, it includes a fixed end 34 and a free end 36. The fixed end 34 is secured to the wrist cuff area of the glove 10 on the palm side. A ring connector 38 is also secured to the fixed end 34. The outer surface of the wrist strap 32 is provided with a wrist strap attaching means for securing the wrist strap 32. The wrist strap attaching means comprises a cooperative hook and loop type fastener which covers the exterior surface of the wrist strap 32. In particular, the portion of the exterior surface of the wrist strap 32 extending from the fixed end 34 to approximately the middle of the wrist strap 32 is covered with a Velcro® type hook fastener 40. The portion of the wrist strap 32 extending from the middle of the wrist strap 32 to the free end thereof is covered with a Velcro® type loop fastener 42. When pressed together, the individual hooks of the Velcro® type hook fastener 40 entangle with the loops of the Velcro® type loop fastener 42 to releasably hold the components together.

In addition to the wrist support means 30, the present invention also includes a backhand support means 44 for providing compression and support for the backhand muscles, and providing additional support for the user's wrist. The backhand support means 44 includes an elastic backhand strap 46 and a hold down strap 48. The backhand strap 46 is preferably made of a stretchable material which will provide support for the back of the hand when stretched. The backhand strap 46 is secured to the central portion 11 of the glove 10 adjacent to the index finger stall 16. More particularly, the end of the backhand strap is fixed between the seam joining the palm panel 12 and back panel 14. The free end of the backhand strap 46 includes Velcro® type hook fasteners 50 and 52 on both sides of the free end. A Velcro® type loop fastener 54 is disposed on one side of an intermediate portion of the backhand strap 46. The loop fastener 54 is positioned such that when the backhand strap is wrapped around the user's hand, the loop fastener 54 will be disposed at approximately the middle of the backhand, where it is engaged by the hook fastener 50 on the end of the strap.

The function of the hold-down strap 48 is to secure the free end of the backhand strap to prevent it from inadvertently breaking loose. The hold-down strap 48 is attached to the central portion 11 adjacent to the little finger stall 22 and extends diagonally backward across the back of the hand to meet and engage the free end of the backhand strap. The hold-down strap 48 includes a loop fastener 56 which engages the hook fastener 52 on the top side of the backhand strap 46.

In use, the glove 10 is fitted on to the user's hand. To secure the glove on the user's wrist, the wrist strap 32 is extended around the user's wrist such that the Velcro® type hook and loop fasteners 40 and 42 are exposed. The free end 36 of the wrist strap 32 is passed through the ring connector 38 and then folded back such that the loop fastener 42 is engaged with the hook fastener 40 thereby securing the glove 10 about the user's wrist. The wrist strap 32, in addition to securing the glove 10 in place on the user's hand, also provides support for the user's wrist. The degree of support can be adjusted by the user by either tightening or loosening the wrist strap 32 as desired.

Figure 3:
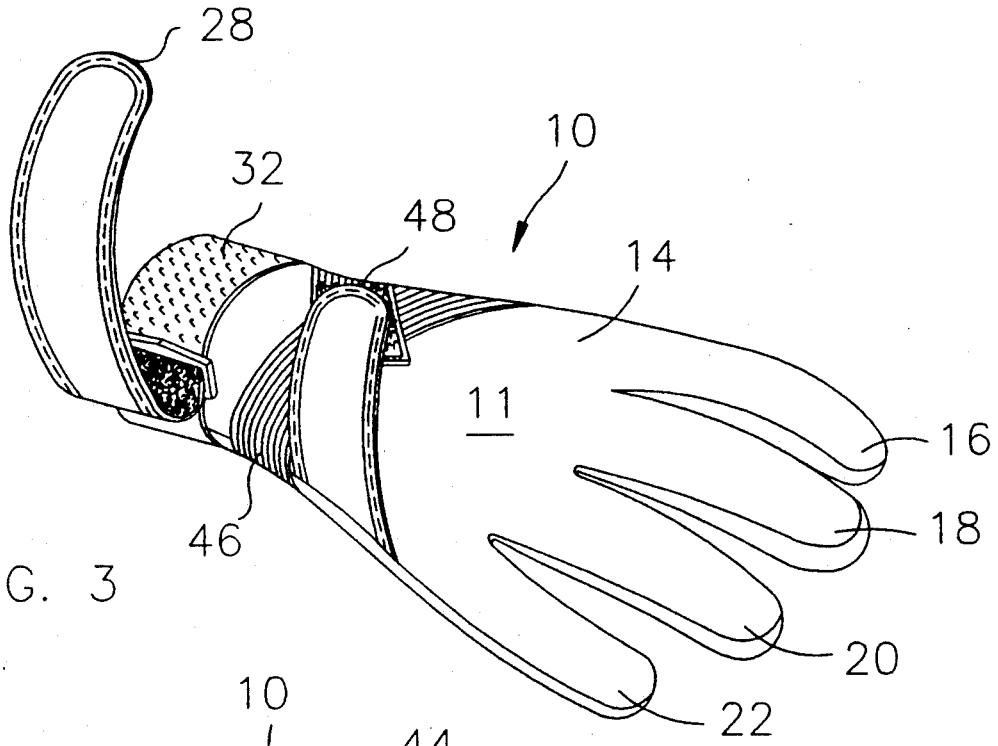
FIG. 3 is a perspective view of the glove looking at the backside from a first point of view.
Figure 4:
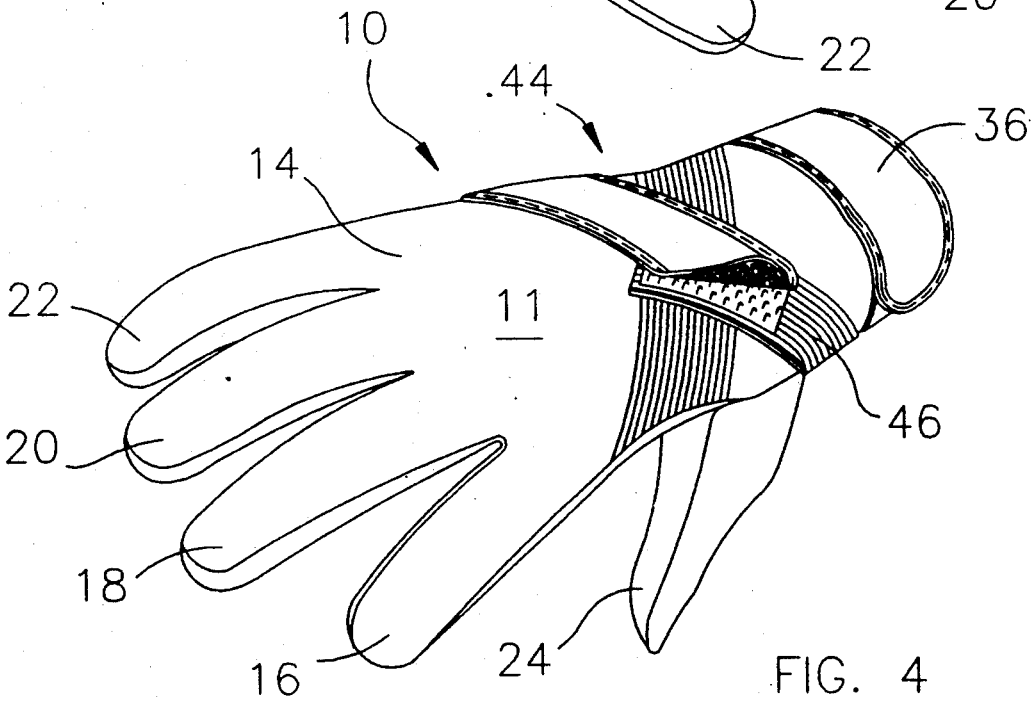
FIG. 4 is a perspective view of the glove looking at the backside from a second point of view.

After securing the glove 10 to the user's hand, the backhand strap 46 is stretched and wrapped around the user's hand to apply pressure to the back of the hand. In particular, the backhand strap 46 extends diagonally across the back of the hand from the base of the index finger toward the outer wrist area of the user's hand, as shown in FIGS. 3 and 4. The backhand strap 46 wraps around the user's wrist from the outer side to the inner side and then extends diagonally across the backhand from the base of the thumb towards the base of the little finger. The free end of the backhand strap 46 then attaches to the loop fastener 54 which is disposed at approximately the center of the backhand. The free end of the backhand strap 46 is secured in place by the hold-down strap 48. In particular, the hold-down strap 48 is extended diagonally across the back of the hand to engage with the free end of the backhand strap 46 and hold it in place.

Once secured, the backhand strap 46 provides support to the backhand muscles to reduce fatigue and to prevent overstraining. The degree of support can be selectively varied by the user. In particular, the amount of support provided is determined by the amount to which the backhand strap 46 is stretched. The more the backhand strap 46 is stretched, the more support is provided.

The present invention may of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A glove having an integral wrap around back strap, comprising:

a) a central portion including a back side and a palm side defining a hand-receiving pocket therebetween;

b) a plurality of finger stalls secured to the central portion for receiving respective fingers and thumb of the user's hand;

c) a hand opening in the central portion for inserting the user's hand into the hand-receiving pocket;

d) a wrist cuff area encircling the user's wrist and bordering the hand opening;

e) backhand support means for compressing and supporting muscles in the back of the user's hand including:

1) a backhand strap having one end integral with the glove for wrapping around the user's hand including an intermediate portion and a free end portion, said backhand strap being fixedly secured to the central portion of the glove and extending diagonally backward across and adjacent the back side of the glove towards the user's wrist, said strap further encircling the underside of the user's wrist and extending from the user's wrist diagonally forward back across the back side of the glove so that the free end portion of the backhand strap extends over and intersects the intermediate portion thereof;

2) an intermediate fastener secured to the intermediate portion of the backhand strap and outwardly exposed on the back side of the glove when the backhand strap is appropriately wrapped around the user's hand; and 3) a cooperative fastener secured to the free end of the backhand strap for connecting to the exposed fastener on the intermediate portion of the backhand strap.

2. The glove according to claim 1 wherein the intermediate fastener and cooperative fastener include hook and loop type fasteners having a loop pad and a hook pad, one of which is secured to the intermediate portion of the backhand strap, and one of which is secured to the free end portion of the backhand strap.

3. The glove according to claim 1 wherein the backhand strap is elastic and stretchable in the longitudinal direction.

4. The glove according to claim 1 further including a hold-down strap for securing the free end of the backhand strap, said hold-down strap being secured to the central portion of the glove and extending diagonally backward and across the back side of the glove and over the attached free end of the backhand strap to releasibly engage the free end of the backhand strap.

5. The glove according to claim 4 further including a second cooperative fastener for releasably securing the hold-down strap to the free end of the backhand strap.

6. The glove according to claim 5 wherein the second cooperative fastener includes a hook and loop type fastener having a loop pad and a hook pad, one of which is secured to the free end portion of the backhand strap and one of which is secured to the hold-down strap.

7. The glove according to claim 1 further including a wrist strap secured to the wrist cuff area of the glove for encircling the user's wrist to secure the glove to the user's hand, said wrist strap having an intermediate portion and a free end portion.

8. The glove according to claim 7 wherein the wrist strap includes means for tightening the wrist strap around the user's wrist.

9. The glove according to claim 8 wherein the tightening means includes a ring connector, said wrist strap extending through the ring connector and folding back on itself such that the free end portion overlies the intermediate portion of the wrist strap.

10. The glove according to claim 9 wherein the wrist strap includes a third cooperative faster for securing the free end portion of the wrist strap to the intermediate portion thereof.

11. The glove according to claim 1 wherein the backhand strap is fixedly secured adjacent to the finger stall of the user's index finger, and wherein a hold down strap is secured adjacent to the finger stall of the user's little finger.

12. A glove comprising:

a) a central portion including a back side and a palm side defining a hand-receiving pocket therebetween;

b) a plurality of finger stalls secured to the central portion for receiving respective fingers and thumb of the user's hand;

c) a hand opening in the central portion for inserting the user's hand into the hand-receiving pocket;

d) a wrist cuff area encircling the user's wrist and bordering the hand opening;

e) backhand support means for compressing and supporting muscles in the back of the user's hand including:

1) an elastic backhand strap having one end integral with the glove stretchable in a longitudinal direction for wrapping around the user's hand including an intermediate portion and a free end portion, said backhand strap being fixedly secured to the central portion of the glove and extending diagonally backward across and adjacent the back side of the glove towards the user's wrist, said strap further encircling the underside of the user's wrist and extending therefrom diagonally forward back across the back side of the glove so that the free end portion of the backhand strap extends over and intersects the intermediate portion thereof;

2) an intermediate fastener secured to the intermediate portion of the backhand strap and outwardly exposed on the back side of the glove when the backhand strap is appropriately wrapped around the user's hand; and 3) a cooperative fastener secured to the free end of the backhand strap for connecting to the exposed fastener on the intermediate portion of the backhand strap.

13. The glove according to claim 12 wherein the intermediate fastener and cooperative fasteners means include hook and loop type fasteners having a loop pad and a hook pad, one of which is secured to the intermediate portion of the backhand strap, and one of which is secured to the free end portion of the backhand strap.

14. The glove according to claim 12 further including a hold-down strap for securing the free end of the backhand strap, said hold-down strap being secured to the central portion of the glove and extending diagonally backward across the back side of the glove to releasably engage the free end of the backhand strap.

15. The glove according to claim 14 further including a second cooperative fastener for releasably securing the hold-down strap to the free end of the backhand strap.

16. The glove according to claim 15 wherein the second cooperative fastener includes a hook and loop type fastener having a loop pad and a hook pad, one of which is secured to the free end portion of the backhand strap and one of which is secured to the hold-down strap.

17. The glove according to claim 12 wherein the wrist support means includes a wrist strap secured to the wrist cuff area of the glove for encircling the user's wrist to secure the glove to the user's hand, said wrist strap having an intermediate portion and a free end portion.

18. The glove according to claim 17 wherein the wrist strap includes means for tightening the wrist strap around the user's wrist.

19. The glove according to claim 18 wherein the tightening means includes a ring connector, said wrist strap extending through the ring connector and folding back on itself such that the free end portion of the wrist strap overlies the intermediate portion thereof.

20. The glove according to claim 19 wherein the wrist strap includes a third cooperative faster for securing the free end portion of the wrist strap to the intermediate portion thereof.

21. The glove according to claim 12 wherein the backhand strap is secured adjacent to the finger stall of the user's index finger, and wherein a hold down strap is secured adjacent to the finger stall of the user's little finger.

* * * * *